US007726274B2

(12) United States Patent
Brinkmann et al.

(10) Patent No.: US 7,726,274 B2
(45) Date of Patent: Jun. 1, 2010

(54) INTERNAL COMBUSTION ENGINE CYLINDER HEAD

(75) Inventors: Franz J. Brinkmann, Huerth-Efferen (DE); Achim Mennicken, Eupen (BE)

(73) Assignee: Ford Global Technologies, Dearborn, MI (US)

( * ) Notice: Subject to any disclaimer, the term of this patent is extended or adjusted under 35 U.S.C. 154(b) by 0 days.

(21) Appl. No.: 11/968,227

(22) Filed: Jan. 2, 2008

(65) Prior Publication Data

US 2008/0156288 A1 Jul. 3, 2008

(30) Foreign Application Priority Data

Jan. 2, 2007 (EP) ..... 07100025

(51) Int. Cl.
*F02F 1/42* (2006.01)

(52) U.S. Cl. ..... 123/193.5; 123/193.3; 123/470

(58) Field of Classification Search ..... 123/188.14, 123/193.5, 470, 635, 193.3
See application file for complete search history.

(56) References Cited

U.S. PATENT DOCUMENTS

| | | | | |
|---|---|---|---|---|
| 2,316,697 | A * | 4/1943 | Latta | 123/262 |
| 2,687,714 | A * | 8/1954 | Flatz et al. | 123/193.5 |
| 3,982,504 | A * | 9/1976 | Noguchi et al. | 123/260 |
| 4,844,040 | A * | 7/1989 | Leighton et al. | 123/306 |
| 4,967,708 | A | 11/1990 | Linder et al. | |
| 5,630,389 | A * | 5/1997 | Self | 123/193.3 |
| 5,676,107 | A | 10/1997 | Yuzuriha | |
| 6,006,711 | A | 12/1999 | Watanabe | |
| 6,431,137 | B1 * | 8/2002 | Paul | 123/193.5 |
| 6,748,926 | B2 * | 6/2004 | Lee et al. | 123/470 |
| 2002/0179044 | A1 | 12/2002 | Yoshaki | |

FOREIGN PATENT DOCUMENTS

| | | | |
|---|---|---|---|
| DE | 649297 | C1 | 8/1937 |
| EP | 0921289 | B1 | 1/1998 |
| EP | 0921286 | A2 | 6/1999 |
| FR | 2307960 | A1 | 11/1976 |
| JP | 01056915 | A | 3/1989 |
| JP | 08061190 | A | 3/1996 |

* cited by examiner

*Primary Examiner*—Stephen K Cronin
*Assistant Examiner*—Anthony L Bacon
(74) *Attorney, Agent, or Firm*—Jerome R. Drouillard; Julia Voutyras

(57) ABSTRACT

An internal combustion engine having at least one cylinder, a block, and a cylinder head having at least one gas exchange channel for conducting gases to and from the cylinder is disclosed. A tube passes through the cylinder head and into a gas exchange channel, which tube is sealed in a gastight manner. In one embodiment, the tube is configured in one piece with the gas exchange channels; the cylinder head is a cast part. With such a tube through the gas exchange channel, the engine can be compactly configured.

1 Claim, 4 Drawing Sheets

INTERNAL COMBUSTION ENGINE CYLINDER HEAD

FIELD OF THE INVENTION

The invention relates to a cylinder head for an internal combustion engine which has at least one cylinder and at least two gas exchange channels, namely at least one intake channel for feeding the fresh air for the fresh mixture through at least one intake opening into the at least one cylinder and at least one exhaust channel for leading the combustion gases away through at least one exhaust opening from the at least one cylinder. Furthermore, the invention relates to a method for forming a cylinder head of this type.

BACKGROUND OF THE INVENTION

The cylinder block has a corresponding number of cylinder bores for receiving the pistons. The piston serves to transmit the gas forces which are generated by the combustion to the crankshaft. For this purpose, the piston is connected in an articulated manner to the crankshaft by a connecting rod.

The cylinder head usually serves to receive the air and fuel and to exhaust the spent gases after combustion. In four stroke engines, almost exclusively poppet valves are used to control the gas exchange, which poppet valves perform an oscillating reciprocal movement during the operation of the internal combustion engine, opening and closing the intake and the exhaust ports. At least a portion of the intake and exhaust channels is integrated into the cylinder head.

The design of the cylinder head is influenced greatly by the components and elements which are required for the gas exchange: both in providing the gas channels and the valve timing mechanism for actuating and controlling the intake and exhaust valves.

For example, the generation of what is known as a tumble or a swirling flow can accelerate and assist the mixture formation. A tumble is an air eddy about an imaginary axis extending roughly parallel to the axis of the crankshaft, in contrast to swirl which represents an air eddy extending parallel to the axis of the cylinder.

The problems with regard to the very limited installation space in and on the cylinder head are increased by the fact that modern designs for internal combustion engines provide four or five valves per cylinder, which requires or necessitates a corresponding number of cylinder openings and gas exchange channels.

In addition, in spark ignition internal combustion engines, the required ignition apparatus and, moreover, in particular in the case of direct injection internal combustion engines, injector are to be arranged in the cylinder head. For this purpose, the required installation space not only has to be provided, but to optimize the mixture formation and the combustion process, a defined arrangement of the ignition apparatus and the injection device in the combustion chamber is desired.

Therefore, in direct injection internal combustion engines, an injection jet which is directed counter to the tumble can be expedient to distribute the fuel in the entire combustion chamber. This presupposes corresponding positioning of the injection nozzle.

If the internal combustion engine is liquid cooled, a plurality of coolant channels are provided in the cylinder head, which coolant channels guide the coolant through the cylinder head. The arrangement of coolant channels leads to an extremely complex structure of the cylinder head construction. The cylinder head is subjected to high mechanical and thermal loads which weaken its strength by the introduction of the coolant channels. Because the energy is conducted to the cylinder head surface before being dissipated, the coolant channels are designed to guide the coolant flow as close as possible to those regions of the cylinder head which are subjected to high thermal loads, i.e., in the vicinity of the combustion chamber In small, highly pressure-charged engines, liquid cooling is of even greater importance than in conventional internal combustion engines.

To connect the cylinder head to the cylinder block, bores are provided both in the cylinder head and in the cylinder block, the cylinder block and the cylinder head being arranged for assembly with respect to one another in such a way that the bores are aligned with one another. Typically, a gasket is placed in between the block and the head to achieve reliable sealing of the combustion chambers. The cylinder head is connected to the cylinder block by threaded bolts which are introduced into the bores of the cylinder head and the cylinder block and are tightened. Typically, there are four bolts around each cylinder.

Typically, the cylinder head is a cast part; thus, aspects which relate to casting technology also have to be considered during the design and production. For example, the cylinder head wall thickness should vary only slightly and not suddenly. Sharp-edged transitions are to be avoided and a minimum wall thickness is to be maintained.

The development toward more compact cylinder heads is also motivated or driven by the fact that internal combustion engines are increasingly equipped with a pressure-charging device, i.e., a supercharger or a turbocharger. The pressure-charging device provides increased power output with an unchanged displacement or allows a displacement reduction with the same power output, i.e., downsizing.

To package the engine, particularly when the bore diameters and bore spacing is smaller challenges the designer to provide all of the functions described above as well as maintain a cost-effective design.

According to one approach, the various components to be integrated into the cylinder head are combined. German laid-open publication DE 37 31 211 A1 (equivalent to U.S. Pat. No. 4,967,708) describes, for example, a fuel injection valve configured integrally with an ignition apparatus, forming one contiguous, compact component. As a result, the number of components to be arranged in the cylinder head is reduced and the installation space required by these components is reduced.

However, a combined ignition/injection device of this type is an expensive component. Secondly, a close arrangement of this type of the ignition apparatus and the injection device is also not desirable in all applications. The ignition apparatus and the injection device are optionally to be arranged spaced apart from one another in the cylinder head.

German laid-open publication DE 197 53 965 A1 (equivalent to EP 921289 B1) describes an internal combustion engine in which the injection valve extends substantially within the intake channel, to reduce the required installation space, and in the process is arranged next to the intake valve. This is also intended to be advantageous because the injection valve is cooled by the fresh air which is sucked in as a consequence of the arrangement in the channel. However, this advantage largely disappears when high rates of exhaust gases are recirculated into the intake. Furthermore, the gas exchange is influenced in an uncontrolled manner by the placement of the injection valve in the intake channel. The introduction of the valve into the channel also requires sealing of the valve with respect to the channel, to prevent fresh air or fresh mixture escaping out of the intake channel into the surroundings.

SUMMARY OF THE INVENTION

An internal combustion engine having at least one cylinder, a block, and a cylinder head having at least one gas exchange channel for conducting gases to and from the cylinder is disclosed. A tube passes through the cylinder head and into a gas exchange channel, which tube is sealed in a gastight manner. In one embodiment, the tube is configured in one piece with the gas exchange channels; the cylinder head is a cast part.

In one embodiment, the tube extends through an upper surface of the gas exchange channel and into the cylinder head. A spark plug or a fuel injector may be installed into the cylinder head through the tube.

In another embodiment, the tube is substantially parallel to the axis of the cylinder. An upper side of the block has threads substantially parallel to the tube, with the threads formed to accept a head bolt which extends through the tube and engages in the threads formed in the block.

Also disclosed is a method for machining an internal combustion engine. The engine has a cylinder head and at least one cylinder formed in a block with at least two gas exchange channels in the cylinder head. A bore is machined through an upper portion and a lower portion of one of the gas exchange channels. A bore is machined into the block and threads formed in the bore, with the bore being collinear with the bore through upper and lower portions of the exchange channel. A bolt is installed through the bores engaged into the threads. A gastight plug is installed in the upper portion of the bore.

In yet another embodiment, a method for machining an internal combustion engine having a cylinder head with at least two gas exchange channels and at least one cylinder formed in a block is disclosed in which a bore is machined through an upper portion and into a lower portion of one of the gas exchange channels. A tube is inserted into the bore and the tube is sealed within the bore. Where the lower portion of the gas exchange channel opens into the cylinder is machined to accommodate a spark plug, or alternatively, an injector.

In yet another embodiment, a method for machining an internal combustion engine having a cylinder head with at least two gas exchange channels and at least one cylinder formed in a block is disclosed in which a bore parallel to the cylinder is machined through an upper portion and into a lower portion of one of the gas exchange channels. A tube is inserted into the bore and the tube is sealed within the bore. A bore, collinear to the bore through the gas exchange channel is machined in the block and threaded to engage with a head bolt when assembled.

In the above embodiments, the gas exchange channel is an intake port or, alternatively, an exhaust port.

According to the invention, the tube is provided in at least one gas exchange channel. Although the flow cross section of the intake and/or exhaust channel is reduced by the arrangement of the tube in the intake and/or exhaust channel. The flow in the channel is changed; however, the gas exchange is not necessarily influenced in an uncontrolled manner, as in the case, for example, of the direct arrangement of an injection valve in the intake channel, which is described in DE 197 53 965 A1 (equivalent to EP 921289 B1). Rather, the tube can be configured in a targeted manner in such a way that swirl, tumble, or another predefined and suitable flow is generated.

The tube serves to receive an ignition apparatus, an injection apparatus or a cylinder head fastening means and at the same time insulates the respective component with respect to the flow in the gas exchange channel. The tube may be press fit into place, cast in place, or placed in the bore provide for it with a sealant to provide the gas tight seal.

In addition, the provision of the tube simplifies the assembly and dismantling of the corresponding component inserted into the tube. Sealing of the component which is inserted into the gas exchange channel is not required. Although the tube also is sealed with respect to the surroundings so that no leakage flow escapes from the gas exchange channel; this sealing is realized more simply than if the component were introduced directly into the gas exchange channel.

The injection apparatus can be an outwardly opening injection nozzle, for example an injection nozzle which operates according to the piezoelectric principle and, within the context of the injection, opens its nozzle tip to the outside, i.e., pintle moves into the combustion chamber. However, an inwardly opening multiple hole injection nozzle which affords cost advantages with respect to the abovementioned piezoelectrically controlled injection nozzle can also serve as injection apparatus.

Embodiments of the cylinder head, in which the at least one shaft is not enclosed completely by the associated gas exchange channel but reaches only partially into the gas exchange channel, are also to be considered to be cylinder heads according to the invention, as long as the tube leads through the gas exchange channel.

However, embodiments are advantageous, in which the tube is integrated completely into the gas exchange channel, as the greatest space saving is achieved as a result of this.

An advantage of the present invention is the efficient use of the limited available space in the cylinder head.

DETAILED DESCRIPTION

Figure 1:
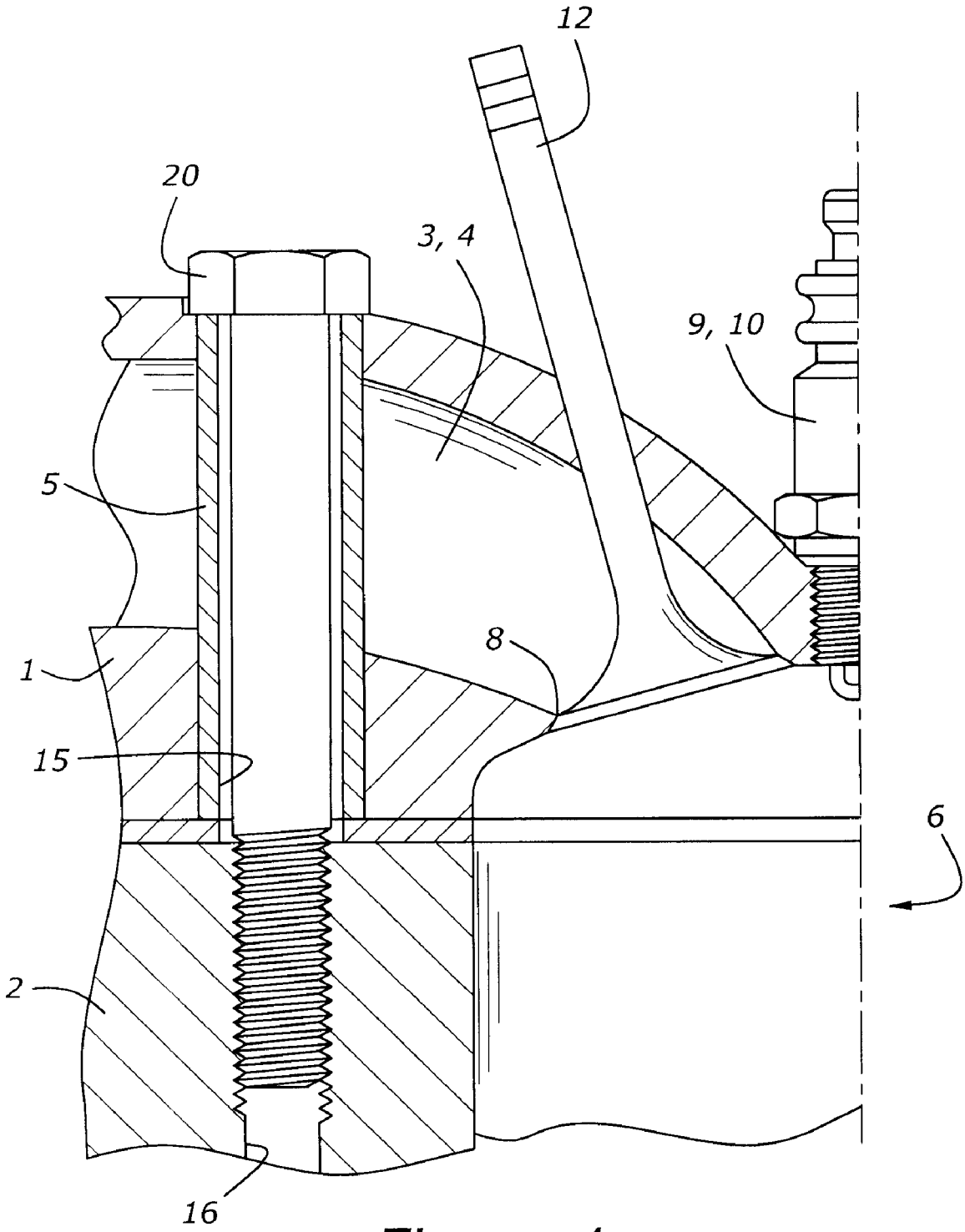
FIGS. 1-4 show a cross-section of half of the cylinder head according to various aspects of the present invention.

Cylinder 6 is formed in block 2, cylinder 6 forming a combustion chamber with the roof portion of cylinder head 1. A head gasket is shown in between block 2 and cylinder head 1. A spark plug 10 arranged in cylinder head 1 serves as an ignition source. There are at least two openings 8 between cylinder 6 and two gas exchange channels 3 with an overhead poppet valve 12 closing off the flow, with although only one is shown in the Figures. Valve 12 is depressed by a valve mechanism (not shown) at an appropriate time in the cycle to allow gases to flow between cylinder 6 and gas exchange channel 3. At a minimum, the gas exchange channels 3 include one exhaust and one intake. In modern engines, it is common to have more than one of each, with two each being more commonly found.

Bores 15, 16 are provided to connect cylinder head 1 to the cylinder block 2, the cylinder block 1 and the cylinder head 2 being arranged for assembly (as shown in FIG. 1) in such a way that the bores 15, 16 are aligned with one another. A threaded bolt 20 is inserted into the bores 15, 16 of the cylinder head 1 and engaged into the threads in cylinder block 2. In FIG. 1, bore 16 is shown to extend through block 2. Alternatively, bore 16 extends just far enough to provide enough threads to engage with bolt 20 to provide the appropriate clamping force.

Figure 2:
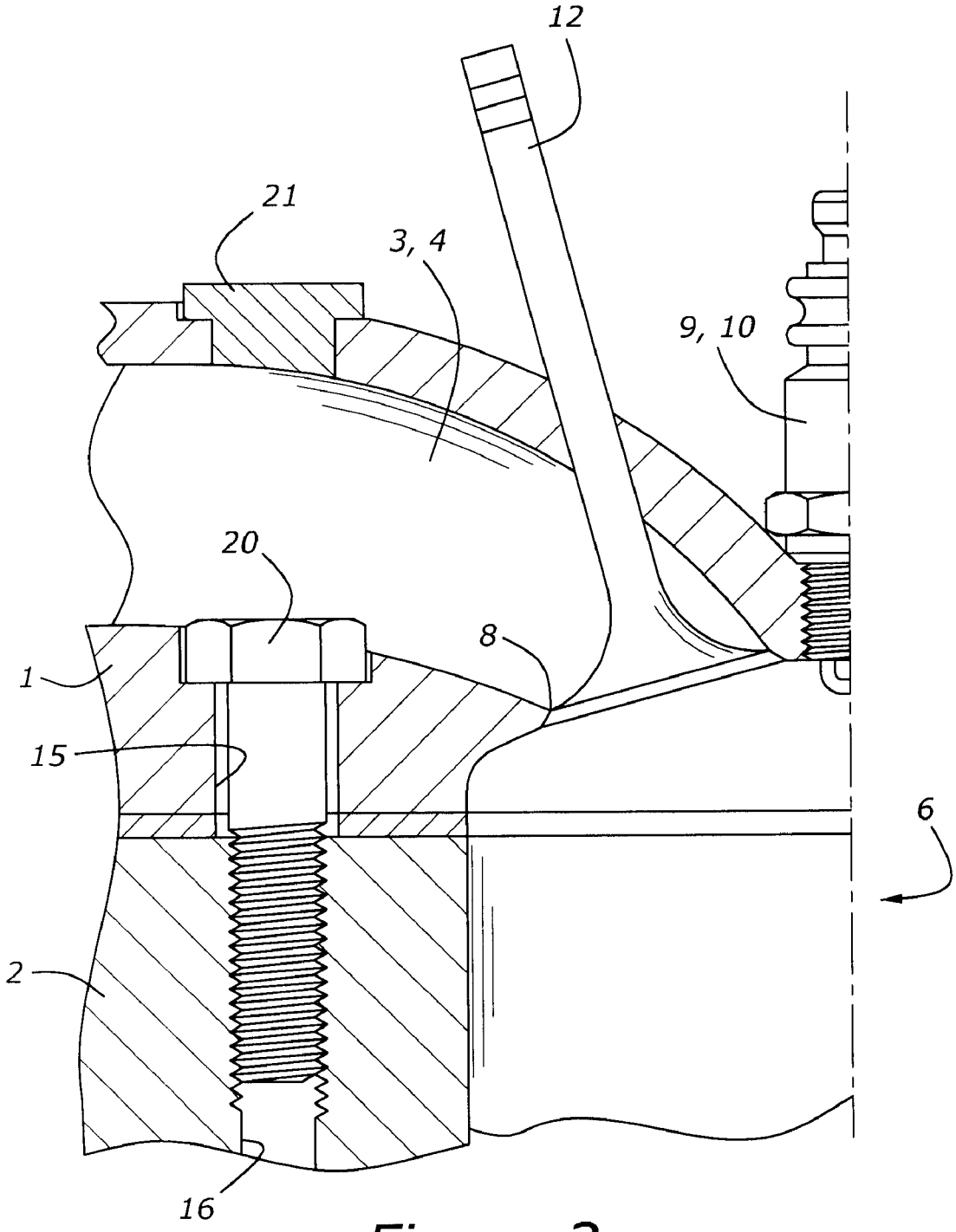

FIG. 2 is similar to FIG. 1, except that FIG. 2 has no tube 5. The head of bolt 20 sits on the lower side of gas exchange channel 3. The hole bored through the upper side of gas exchange channel 3 is sealed with plug 21. In this configuration, bolt 20 is installed through gas exchange channel 3 without interfering with the gas flow, except for any disruption of the flow along the lower surface of gas exchange channel 3 due to head of bolt 20.

Figure 3:
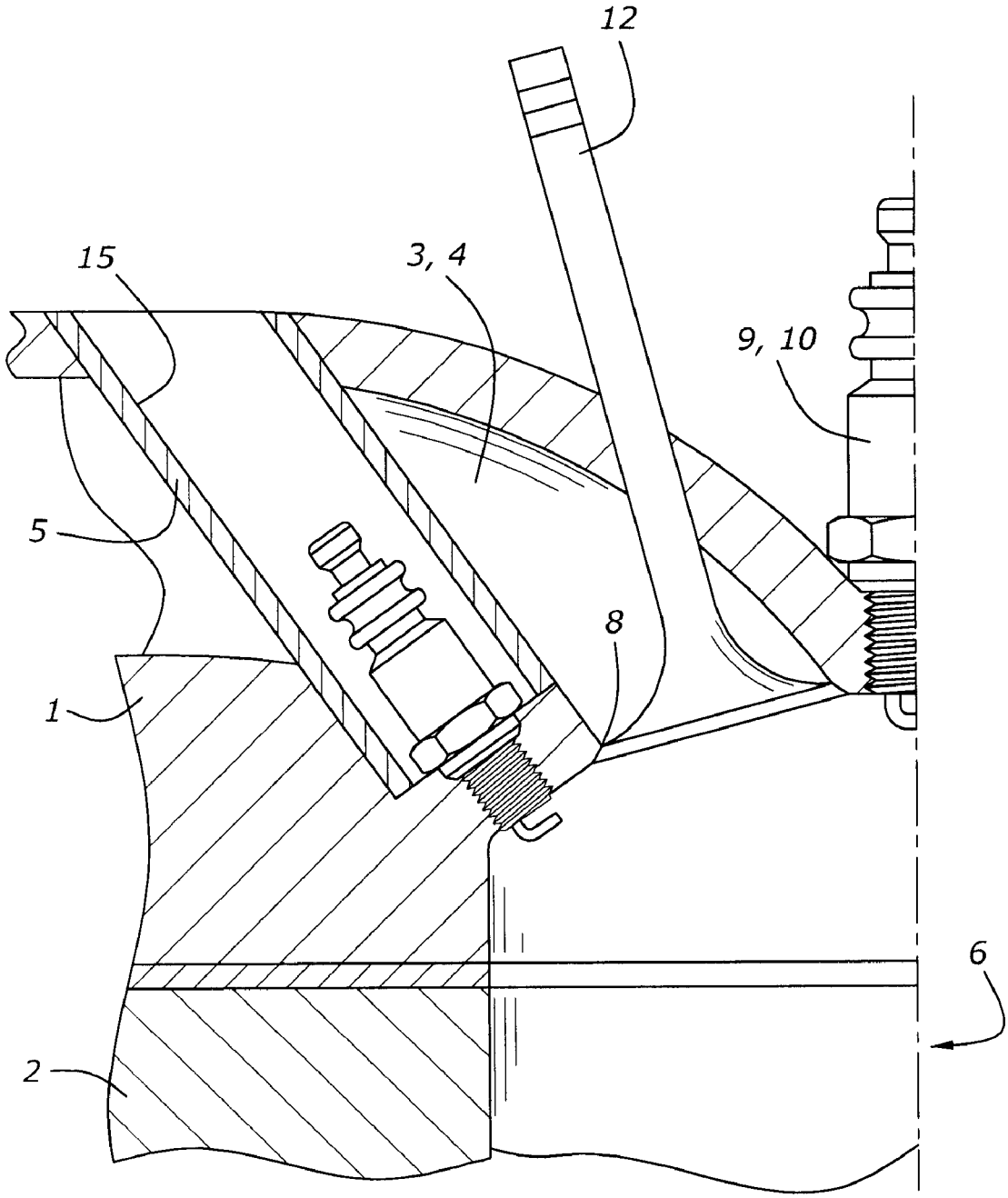
Figure 4:
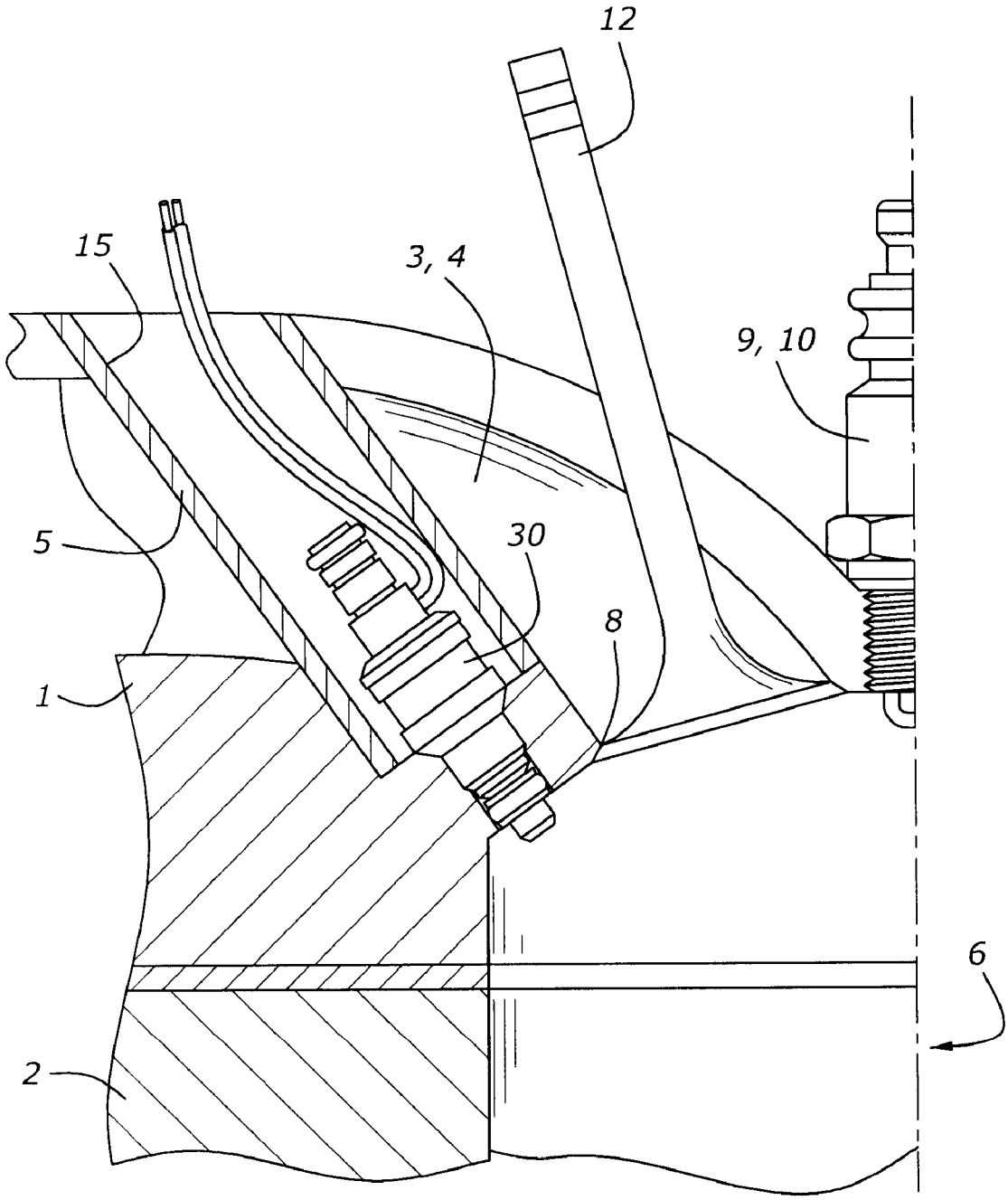

In FIG. 3, the bore traverses through the upper surface of gas exchange channel 3 and the lower surface of gas exchange channel 3 in such a direction that it pierces cylinder head 1 to gain access to cylinder 6. A tube 5 is inserted in the bore to protect the component that is installed into cylinder head 1. The component installed into cylinder head 1, in one embodiment, is a spark plug. In FIG. 3, a centrally-mounted spark plug 9 is shown. It is known to be advantageous to have two spark plugs in cylinder head 1. Alternatively, instead of a spark plug, element 9 is a direct fuel injector. In another alternative, FIG. 4 shows a direct fuel injector, 30, installed into cylinder head 4 through tube 5 and providing side injection.

Cylinder head 1 in FIGS. 1-4 do not show a water cooling jacket, which is commonly used. Of course, the present invention can be used with a cylinder head having water cooling.

We claim:

1. An internal combustion engine having at least one cylinder (6), a block (2), and a cylinder head (1) having at least one gas exchange channel (3) for conducting gases to and from the cylinder (6), comprising: a tube (5) passing through the cylinder head (1) and into the gas exchange channel (3), and with said engine further comprising a direct fuel injector installed into the cylinder head through said tube.

* * * * *